US010399757B2

(12) United States Patent
Hom

(10) Patent No.: US 10,399,757 B2
(45) Date of Patent: Sep. 3, 2019

(54) PACKET WITH INTEGRATED SCRUBBER

(71) Applicant: COLGATE-PALMOLIVE COMPANY, New York, NY (US)

(72) Inventor: Frank Hom, Wayne, NJ (US)

(73) Assignee: Colgate-Palmolive Company, New York, NY (US)

( * ) Notice: Subject to any disclaimer, the term of this patent is extended or adjusted under 35 U.S.C. 154(b) by 206 days.

(21) Appl. No.: 15/236,886

(22) Filed: Aug. 15, 2016

(65) Prior Publication Data

US 2018/0044087 A1 Feb. 15, 2018

(51) Int. Cl.

| | |
|---|---|
| ***B65D 75/28*** | (2006.01) |
| ***B65D 75/52*** | (2006.01) |
| ***B65D 75/58*** | (2006.01) |
| ***A47L 13/17*** | (2006.01) |
| ***A47L 17/08*** | (2006.01) |
| ***A47L 25/00*** | (2006.01) |

(Continued)

(52) U.S. Cl.

CPC ..... *B65D 75/28* (2013.01); *A47L 13/17* (2013.01); *A47L 17/08* (2013.01); *A47L 25/00* (2013.01); *B08B 1/006* (2013.01); *B65D 41/32* (2013.01); *B65D 75/527* (2013.01); *B65D 75/5816* (2013.01); *B65D 75/5822* (2013.01); *B65D 75/5866* (2013.01)

(58) Field of Classification Search

CPC ..... B65D 85/8043; B65D 85/804; B65D 85/8046; B65D 75/28; B65D 75/527; B65D 75/5866; B65D 75/5816; B65D 41/32; B65D 81/32; B65D 81/3205; B65D 81/3211; B65D 1/36; B65D 75/5822; B08B 1/006; B65B 9/10; B65B 9/12; B65B 9/20; B65B 43/12; A47L 13/17; A47L 17/08; A47L 25/00

See application file for complete search history.

(56) References Cited

U.S. PATENT DOCUMENTS

| | | | | |
|---|---|---|---|---|
| 3,189,227 A * | 6/1965 | Hobbs | ..... | B65D 75/40 206/820 |
| 4,203,587 A | 5/1980 | Dugan | | |
| 4,330,220 A | 5/1982 | Scheer et al. | | |

(Continued)

FOREIGN PATENT DOCUMENTS

| | | |
|---|---|---|
| EP | 1777173 | 4/2007 |
| EP | 2480462 | 8/2012 |

(Continued)

OTHER PUBLICATIONS

International Search Report and Written Opinion of the International Searching Authority in International Application No. PCT/US2017045243, dated Jan. 2, 2018.

*Primary Examiner* — Erik Kashnikow
*Assistant Examiner* — Ericson M Lachica

(57) ABSTRACT

A packet includes a front panel and a back panel defining an internal volume therebetween. The front panel and the back panel include a first edge having a plurality of first recesses formed therein. A nozzle provides a path of fluid communication from the internal volume, through the first edge, to an exterior of the packet. A consumer product is disposed within the internal volume. A cap is configured to prevent the consumer product from flowing from the internal volume, through the nozzle, and to the exterior of the packet.

14 Claims, 4 Drawing Sheets

(51) Int. Cl.
*B08B 1/00* (2006.01)
*B65D 41/32* (2006.01)

(56) References Cited

U.S. PATENT DOCUMENTS

| | | | | |
|---|---|---|---|---|
| 5,111,932 | A | 5/1992 | Campbell | |
| 5,634,572 | A | 6/1997 | Lane, Jr. et al. | |
| D512,650 | S * | 12/2005 | Dapsance | D9/707 |
| 2007/0059405 | A1 | 3/2007 | Segal | |
| 2009/0003737 | A1 * | 1/2009 | Risgalla | B65D 75/48 383/74 |
| 2009/0181133 | A1 | 7/2009 | Luber et al. | |
| 2014/0311524 | A1 | 10/2014 | Call | |

FOREIGN PATENT DOCUMENTS

| | | |
|---|---|---|
| EP | 2738110 | 7/2014 |
| JP | 3806484 | 8/2006 |
| WO | 2007113066 | 10/2007 |
| WO | 2009101970 | 8/2009 |

* cited by examiner

PACKET WITH INTEGRATED SCRUBBER

BACKGROUND

For many years, a user would pour a cleaning solution (e.g., soap) from a bottle onto an object to be cleaned (e.g., a dirty dish). The user would then scrub the object with a sponge or brush. More recently, brushes have been developed that have an internal reservoir for storing the cleaning solution. For example, as the user is scrubbing the object with the brush, the user may selectively dispense the cleaning solution from the internal reservoir of the brush onto the object. However, conventional brushes with the internal reservoirs are large, heavy, and relatively expensive. What is needed is an improved apparatus with a cleaning solution stored therein that may be used as a scrubber.

BRIEF SUMMARY

A packet is disclosed. The packet includes a front panel and a back panel defining an internal volume therebetween. The front panel and the back panel include a first edge having a plurality of first recesses formed therein. A nozzle provides a path of fluid communication from the internal volume, through the first edge, to an exterior of the packet. A consumer product is disposed within the internal volume. A cap is configured to prevent the consumer product from flowing from the internal volume, through the nozzle, and to the exterior of the packet.

A plurality of packets is also disclosed. The plurality of packets includes a first packet and a second packet. The first and second packets each include a front panel and a back panel defining an internal volume therebetween. The front panel and the back panel include a first edge having a plurality of first recesses formed therein. A nozzle provides a path of fluid communication from the internal volume and through the first edge. A consumer product is disposed within the internal volume. A cap is configured to prevent the consumer product from flowing from the internal volume and through the nozzle. The first edge of the first packet is coupled to a second, opposing edge of the second packet.

A method for cleaning an object is also disclosed. The method includes opening a packet and causing a consumer product to flow out of the packet onto the object. The method also includes reducing a distance between two edges of the first packet, and scrubbing the consumer product on the object using the packet when the distance is reduced.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
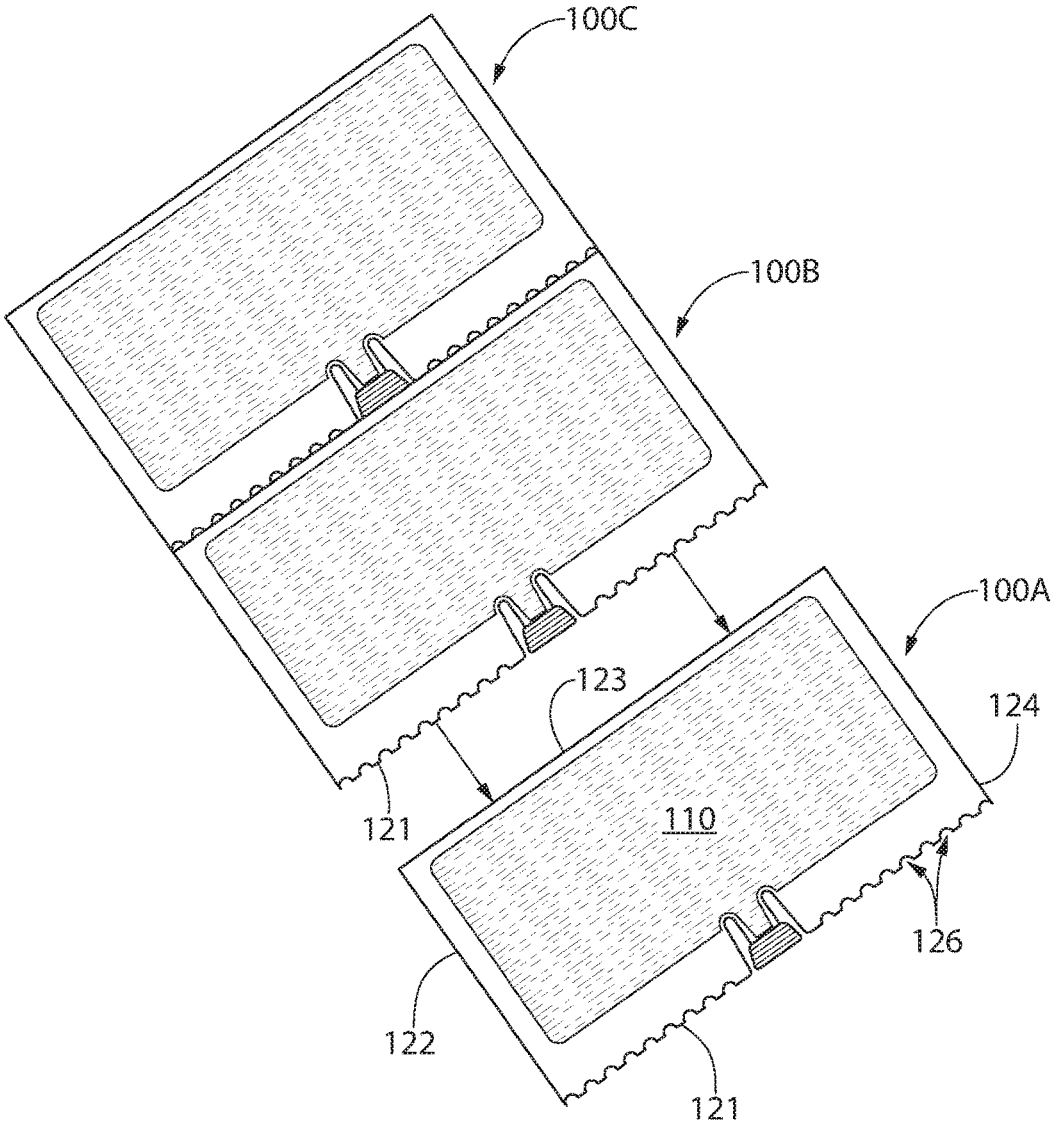
FIG. 1 depicts a schematic view of a plurality of packets, according to an embodiment.

FIG. 1 depicts a schematic view of a plurality of packets 100A-100C, according to an embodiment. In at least one embodiment, each packet 100A-C may be or include a sachet having a front panel 110 and a back panel 112 (shown in FIG. 4). The front panel 110 and the back panel 112 may each have a thickness from about 40 μm to about 400 μm or from about 80 μm to about 150 μm. The front panel 110 and the back panel 112 may be made from, for example, a laminate film. The laminate film may include linear low-density polyethylene ("LLDPE"), an adhesive, a barrier, polyethylene terephthalate ("PET"), or a combination thereof. The adhesive may be or include an ethylene acrylic acid ("EAA") natural copolymer. The barrier may be or include aluminum foil, metalized PET, silicon dioxide coated PET, ethylene vinyl alcohol ("EVOH"), or a combination thereof. In at least one embodiment, the front panel 110, the back panel 112, or both may have a rough exterior surface (i.e., not smooth). For example, the exterior surface(s) may have ridges, protrusions, grit (e.g., like sandpaper), or the like to facilitate scrubbing, as discussed in greater detail below.

The front panel 110 and the back panel 112 of each packet 100A-C may include one or more edges (four are shown: 121-124). The front panel 110 and the back panel 112 of each packet 100A-C may be coupled together proximate to the edges 121-124, such that an internal volume is defined between the front panel 110 and the back panel 112. A consumer product may be disposed within the internal volume. The consumer product may be or include a liquid, a gel, a paste, a powder, or the like. The consumer product may be or include a cleaning solution (e.g., soap, detergent, etc.), toothpaste, mouthwash, shampoo, conditioner, body wash, lotion, or the like.

As shown, the edge 123 of the first packet 100A may be coupled to the edge 121 of the second packet 100B, the edge 123 of the second packet 100B may be coupled to the edge 121 of the third packet 100C, and so on. One or more of the edges (e.g., edge 121) may include a plurality of first recesses 126. The first recesses 126 reduce the surface area of the coupling/connection between the packets 100A-C, which facilitates separation of the packets along this edge 121. In addition, the first recesses 126 may cause the edge 121 to be substantially serrated, which may improve the packets' 100A-C scrubbing efficiency, as discussed below.

As shown, the edges 123 may be smooth (e.g., no recesses); however, in other embodiments, the edges 123 may have a plurality of recesses.

Figure 2A:
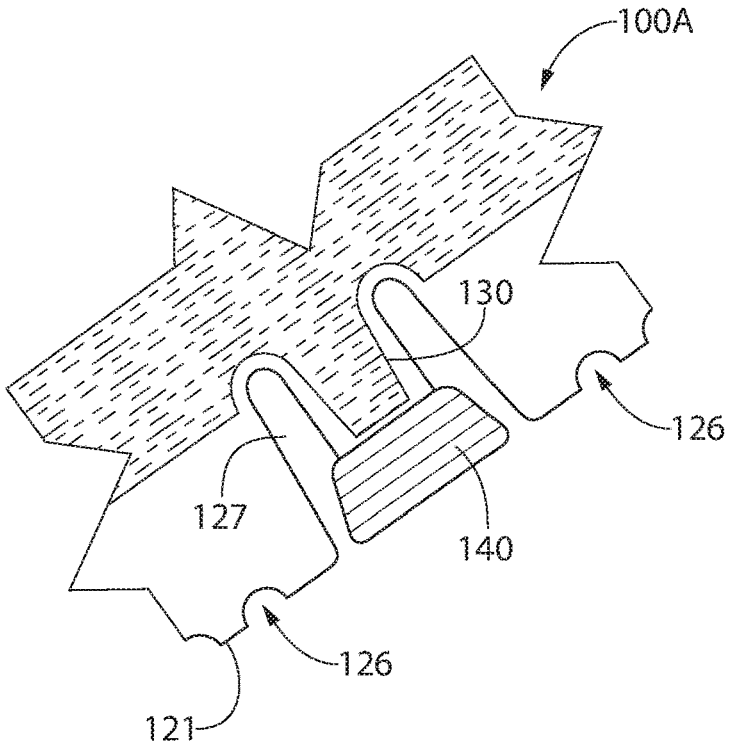
FIG. 2A depicts an enlarged view of a portion of one of the packets showing a cap sealing a nozzle of the packet, according to an embodiment.

FIG. 2A depicts an enlarged view of a portion of the first packet 100A showing a cap 140 sealing a nozzle 130, according to an embodiment. The front panel 110 and the back panel 112 may define the nozzle 130, and a path of fluid communication may exist from the internal volume, through the nozzle 130, to the exterior of the packet 100A. The nozzle 130 may extend through one of the edges (e.g., edge 121). The edge 121 through which the nozzle 130 extends may include the first recesses 126. The edge 121 through which the nozzle 130 extends may also define a second recess 127, and an end of the nozzle 130 may be positioned within the second recess 127. The second recess 127 may be deeper than the first recesses 126 (as shown), or the second recess 127 may be the same depth as the first recesses 126. The second recess 127 may be positioned axially-between two of the first recesses 126.

The end of the nozzle 130 may be sealed by the cap 140. The cap 140 may be positioned at least partially in the second recess 127. As shown, an outer edge of the cap 140 may be substantially aligned with at least a portion of the edge 121 of the first packet 100A.

Figure 3:
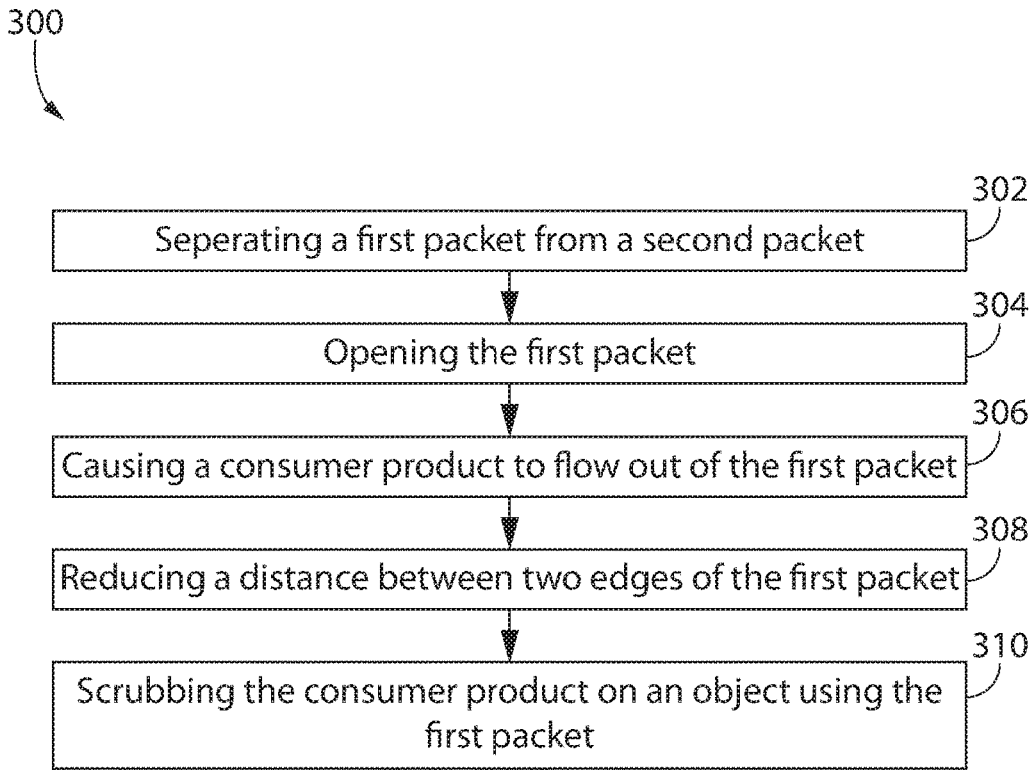
FIG. 3 depicts a flowchart of a method for using a packet to clean an object, according to an embodiment.

FIG. 3 depicts a flowchart of a method 300 for using a packet 100A to clean an object 500, according to an embodiment. The method 300 may include separating a first packet 100A from a second packet 100B, as at 302. In one example, the first packet 100A may be separated from the second packet 100B (e.g., by tearing) along the serrated edge 121 of the second packet 100B, as shown in FIG. 1.

Figure 2B:
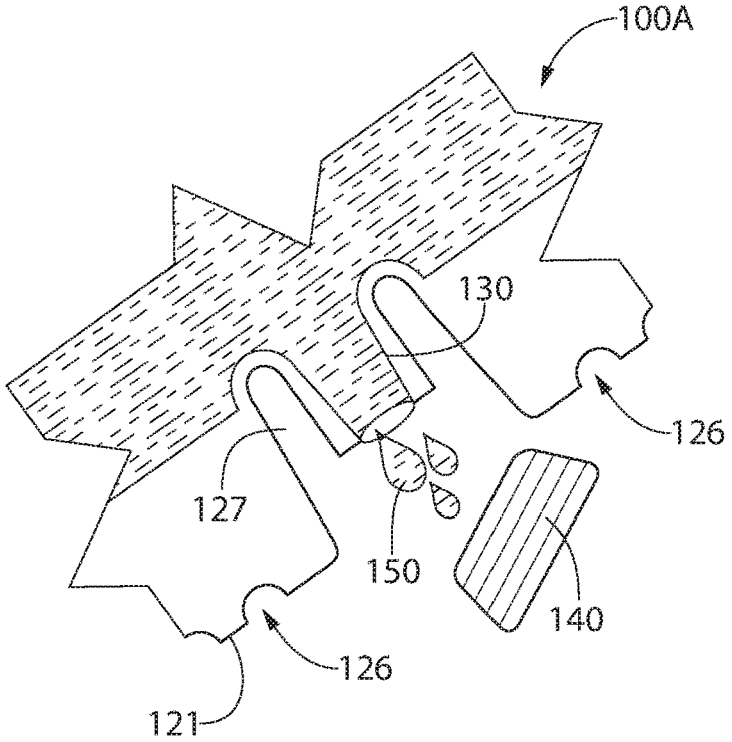
FIG. 2B depicts an enlarged view of the packet shown in FIG. 2A showing the cap removed to allow a consumer product within the packet to flow out of the packet through the nozzle, according to an embodiment.

The method 300 may also include opening the first packet 100A, as at 304. As shown in FIG. 2B, the first packet 100A may be opened by removing the cap 140 from the first packet 100A. In another embodiment, the first packet 100A may not include a cap 140, and the first packet 100A may instead be opened by tearing away a corner of the first packet 100A, tearing along a "tear here" dotted line, or a combination thereof, similar to opening a fast-food ketchup packet. In yet another embodiment, the first packet 100A may be opened by puncturing the front panel 110, the back panel 112, or both.

The method 300 may also include causing at least a portion of a consumer product 150 to flow out of the first packet 100A, as at 306. A user may cause the consumer product 150 to flow out of the first packet 100A through the nozzle 130 by squeezing the first packet 100A. The consumer product 150 may flow out of the first packet 100A and onto an object 500 (see FIG. 5).

The method 300 may also include reducing a distance between two edges 122, 124 of the first packet 100A, as at 308. The distance between the two edges 122, 124 may be reduced simultaneously with the consumer product 150 flowing out of the first packet 100A. For example, reducing the distance between the two edges 122, 124 may cause the consumer product 150 to flow out of the first packet 100A. The distance between the two edges 122, 124 may also or instead be reduced after the consumer product 150 flows out of the first packet 100A.

Figure 4:
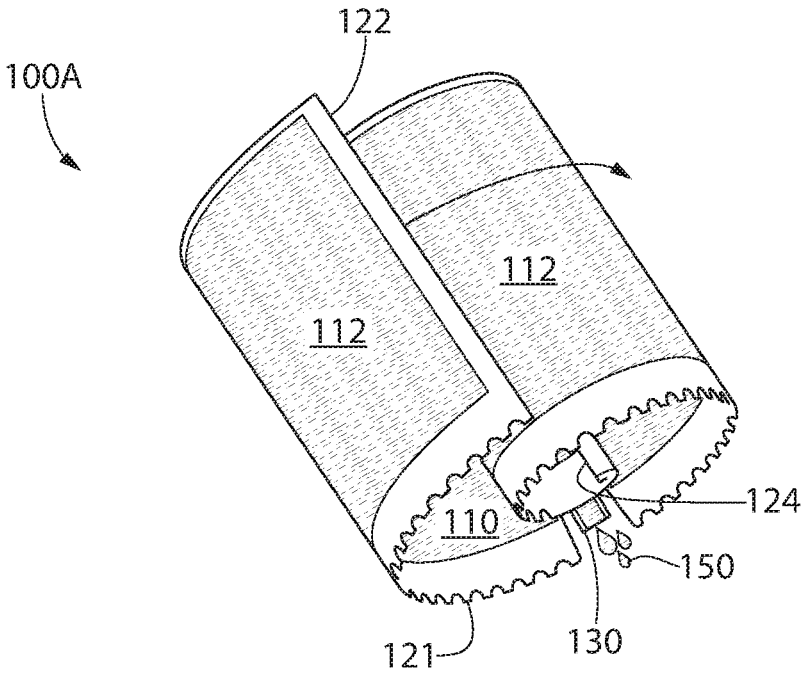
FIG. 4 depicts a perspective view of the packet rolled up, according to an embodiment.

The two edges 122, 124 may be perpendicular to the edge 121 having the nozzle 130 extending therethrough. The two edges 122, 124 may also or instead be perpendicular to the edge 121 having the first recesses 126 (i.e., the serrated edge). In at least one embodiment, reducing the distance between the two edges 122, 124 may include rolling the first packet 110A about a central longitudinal axis that is parallel to the two edges 122, 124, as shown in FIG. 4. In another embodiment, reducing the distance between the two edges 122, 124 may include folding the first packet 100A one or more times along lines that are substantially parallel to the edges 122, 124.

Figure 5:
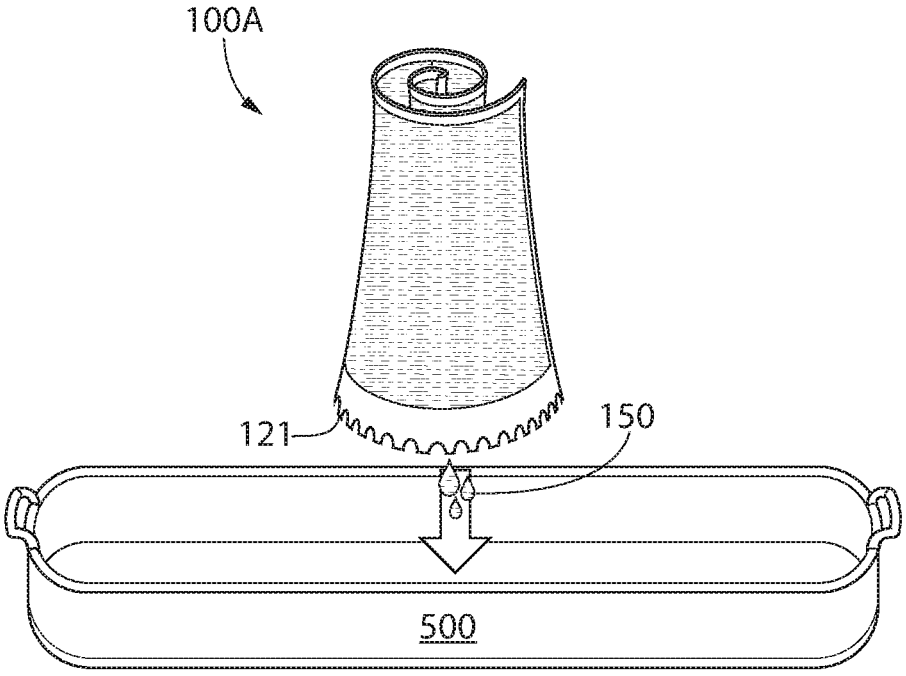
FIG. 5 depicts a perspective view of the packet, in its rolled up configuration, cleaning an object, according to an embodiment.

The method 300 may also include cleaning/scrubbing the consumer product 150 on an object 500 using the first packet 100A, as at 310. FIG. 5 depicts a perspective view of the first packet 100A, in its rolled up configuration, cleaning/scrubbing the object 500. The edge 121 having the nozzle 130 and/or the first recesses 126 may contact the object 500 and be used to scrub the object 500 with the consumer product 150. In some embodiments, the serrated edge 121 may clean the object 500 better than a smooth or straight edge (e.g., edge 123). Reducing the distance between the two edges 122, 124 (e.g., via rolling the first packet 100A), as discussed above, may provide structural rigidity to the first packet 100A as the first packet 100A is used to scrub the object 500. In another embodiment, rather than reducing the distance between the two edges 122, 124, the consumer product 150 may be cleaned/scrubbed on the object 500 using the rough exterior surface of the front panel 110 and/or the back panel 112.

As shown, the object 500 is a pan; however, in other embodiments, the object 500 may be a plate, a dish, a bowl, cutlery, the user's skin (e.g., face, hands, or body), the user's mouth (e.g., teeth or tongue), a countertop, a window, or the like.

What is claimed is:

1. A plurality of packets, comprising:

a first packet and a second packet, wherein the first and second packets each comprise:

a front panel and a back panel defining an internal volume therebetween, wherein the front panel and the back panel comprise a first edge having a plurality of first recesses, and a second recess formed therein, wherein the second recess is deeper than the plurality of first recesses and wherein a nozzle provides a path of fluid communication from the internal volume and through the first edge;

a consumer product disposed within the internal volume; and a cap configured to prevent the consumer product from flowing from the internal volume through the nozzle; and wherein the first edge of the first packet is coupled to a second, opposing edge of the second packet, and wherein an end of the nozzle of the first packet is positioned within the second recess, and wherein the cap of the first packet is positioned between the end of the nozzle of the first packet and the second edge of the second packet.

2. The plurality of packets of claim 1, wherein the second recess is positioned axially-between two of the plurality of first recesses.

3. The plurality of packets of claim 1, wherein the consumer product comprises a cleaning solution, a toothpaste, a mouthwash, a shampoo, a conditioner, a body wash, a lotion, or a food product.

4. The plurality of packets of claim 1, wherein an outer end of the cap of the first packet is substantially aligned with at least a portion of the first edge of the first packet.

5. The plurality of packets of claim 1, wherein an outer surface of the front panel, the back panel, or both the front panel and the back panel comprises a plurality of ridges, protrusions, grit, or a combination thereof to facilitate scrubbing the consumer product onto an object.

6. A method for cleaning an object, comprising:

opening a first packet of a plurality of packets, said plurality of packets comprising the first packet and a second packet, each of the first packet and the second packet comprising: a front panel and a back panel defining an internal volume therebetween, wherein the front panel and the back panel comprise a first edge having a plurality of first recesses and a second recess formed therein, wherein the second recess is deeper than the plurality of first recesses and wherein a nozzle provides a path of fluid communication from the internal volume and through the first edge, the first packet also comprising a cap configured to prevent a consumer product disposed within the internal volume from flowing from the internal volume through the nozzle, wherein the first edge of the first packet is coupled to an opposing edge of the second packet, and wherein an end of the nozzle of the first packet is positioned within the second recess, and wherein the cap of the first packet is positioned between the end of the nozzle of the first packet and the opposing edge of the second packet;

causing the consumer product to flow out of the first packet onto the object;

reducing a distance between the first edge of the first packet and a second edge of the first packet; and scrubbing the consumer product on the object using the first packet when the distance is reduced.

7. The method of claim 6, wherein the consumer product is scrubbed on the object using the first edge of the first packet.

8. The method of claim 7, wherein the first packet comprises a third edge and a fourth edge, each of which are substantially perpendicular to the first edge.

9. The method of claim 8, wherein reducing the distance causes the consumer product to flow out of the first packet.

10. The method of claim 8, wherein reducing the distance comprises rolling the first packet around an axis that is substantially parallel to the second edge.

11. The method of claim 8, wherein opening the first packet comprises removing the cap that is coupled to that first packet.

12. The method of claim 11, wherein the cap is positioned at least partially within the second recess prior to being removed.

13. The method of claim 12, further comprising separating the first packet from the second packet along the first edge of the first packet prior to opening the first packet.

14. The method of claim 6, wherein the object comprises a pan, a plate, a dish, a bowl, cutlery, a countertop, or the mouth or skin of a user.

* * * * *